US006112889A

United States Patent [19]

Wicker

[11] Patent Number: 6,112,889

[45] **Date of Patent: *Sep. 5, 2000**

[54] POCKET HUMIDOR

[75] Inventor: Kenneth R. Wicker, Louisville, Ky.

[73] Assignee: Traveldor LLC, Louisville, Ky.

[ * ] Notice: This patent is subject to a terminal disclaimer.

[21] Appl. No.: 09/182,448

[22] Filed: Oct. 29, 1998

Related U.S. Application Data

[63] Continuation of application No. 08/858,113, May 19, 1997, Pat. No. 5,829,581.

[60] Provisional application No. 60/025,381, Sep. 4, 1996, abandoned.

[51] Int. Cl.[7] ..... B65D 81/28

[52] U.S. Cl. ..... 206/213.1; 206/256; 312/31.3

[58] Field of Search ..... 206/204, 205, 206/213.1, 256, 258, 265, 269, 270; 220/501, 784; 312/31, 31.01, 31.02, 31.04, 31.1–31.3; 428/534, 535

[56] References Cited

U.S. PATENT DOCUMENTS

| | | |
|---|---|---|
| 99,764 | 2/1870 | Doering . |
| D. 140,447 | 2/1945 | Pritzker . |
| D. 147,120 | 7/1947 | Dietrich . |
| D. 379,553 | 5/1997 | DiDianni . |
| D. 386,812 | 11/1997 | Schmidt . |
| 406,076 | 7/1889 | Allen . |
| 441,557 | 11/1890 | Heydt . |
| 469,064 | 2/1892 | McKay . |
| 900,748 | 10/1908 | Leiser . |
| 906,899 | 12/1908 | Kronk . |
| 964,699 | 7/1910 | Sargent . |
| 1,016,492 | 2/1912 | Gunn . |
| 1,087,022 | 2/1914 | Kreh . |
| 1,088,369 | 2/1914 | Romano . |
| 1,205,751 | 11/1916 | King . |
| 1,249,490 | 12/1917 | Prather . |
| 1,318,939 | 10/1919 | Willert . |
| 1,395,467 | 11/1921 | Bayuk . |
| 1,423,356 | 7/1922 | Oakford . |
| 1,462,832 | 7/1923 | Shaw . |
| 1,609,766 | 12/1926 | Osaka . |
| 1,619,306 | 3/1927 | Northup . |
| 1,660,240 | 2/1928 | Sukert . |
| 1,676,118 | 7/1928 | Sukert . |
| 1,830,591 | 11/1931 | Clark . |
| 1,965,129 | 7/1934 | Patterson . |
| 2,276,217 | 3/1942 | Lee . |
| 2,522,952 | 9/1950 | Krohn . |
| 2,860,023 | 11/1958 | Herdlitchka . |
| 2,862,779 | 12/1958 | Hammond . |
| 2,977,171 | 3/1961 | Gleason . |
| 3,023,064 | 2/1962 | Sosa . |
| 3,382,020 | 5/1968 | Meri . |
| 3,458,079 | 7/1969 | Gasbarra . |
| 4,898,273 | 2/1990 | Kristiansen ..... 206/204 |
| 5,418,034 | 5/1995 | McGuire, III ..... 428/534 |
| 5,607,051 | 3/1997 | Espinosa . |

*Primary Examiner*—Jim Foster

*Attorney, Agent, or Firm*—Middleton & Reutlinger; Thomas B. McGurk

[57] ABSTRACT

The present invention relates to a portable humidor that allows for convenient storage and transport of cigars. A three-piece, rigid structure protects the cigars during transport and also includes a humidifying element that maintains the proper humidity level within the device. The humidifying element is housed within a receptacle at the bottom of the container, while a lid at the top of the container provides easy access to the cigars.

5 Claims, 4 Drawing Sheets

POCKET HUMIDOR

CROSS-REFERENCE TO RELATED APPLICATIONS

This application is a continuation of, and claims priority from, my pending U.S. utility patent application Ser. No. 08/858,113, filed on May 19, 1997, U.S. Pat. No. 5,829,581, said '113 patent application being incorporated herein by reference and claiming priority from my U.S. provisional patent application serial No. 60/025,381, filed on Sep. 4, 1996, now abandoned, said '381 provisional patent application being incorporated herein by reference.

BACKGROUND OF THE INVENTION

1. Technical Field of the Invention

The present invention relates to humidors for storing cigars, and, in particular, to a portable humidor which can be carried in a jacket pocket or a purse.

2. Description of the Related Art

Humidors are well-known as a means for keeping cigars at a proper humidity level; however, these humidors are generally large cases, which are not designed to be transported.

Prior art portable humidors have generally taken the form of a thin box or a flask. In attempting to maintain the appropriate humidity, prior art devices have included a humidifying element in the lid of the humidor. This element is saturated with a liquid, mostly common water. These devices, however, are problematic in that the placement of the humidifying element in the lid of the device allows the saturating liquid to drip onto the cigars stored in the humidor.

SUMMARY OF THE INVENTION

One object of the present invention is to provide a humidor that is portable so that an individual can carry it with him. It is a further object of this invention to provide a humidor wherein the saturating liquid cannot drip onto the cigars. Since the focus of the invention is on portability and convenience, it is also an object of this invention to provide a device that allows for easy storage of and access to the cigars. Finally, it is an object of the present invention to provide for easy access to the humidifying element for replenishment of the saturating liquid.

The present invention is a portable humidor. A preferred embodiment of the invention is made of three rigid pieces that snap together. The main body of the device is a container for housing the cigars. Its rigidity prevents the cigars from being crushed while being transported in a pocket or purse. A removable cover attaches to the top of the container to allow for easy access to the cigars. The humidifying element is contained within a receptacle that attaches to the bottom of the container.

The placement of the humidifying element at the bottom of the container prevents liquid from dripping onto or otherwise contacting the cigars. The liquid does not drip down under the force of gravity, and the bottom wall of the container prevents the cigars from contacting the humidifying element itself.

The three-piece structure also permits easy access to the cigars and easy replenishment of the saturating liquid. The top cover is easily removed to add or remove cigars. The lower receptacle may be easily detached and the saturating liquid replenished without disturbing the cigars stored in the container.

Another feature of a preferred embodiment of the present invention is a wooden liner that may be wrapped about the cigars stored in the humidor.

DESCRIPTION OF THE PREFERRED EMBODIMENTS

Figure 1:
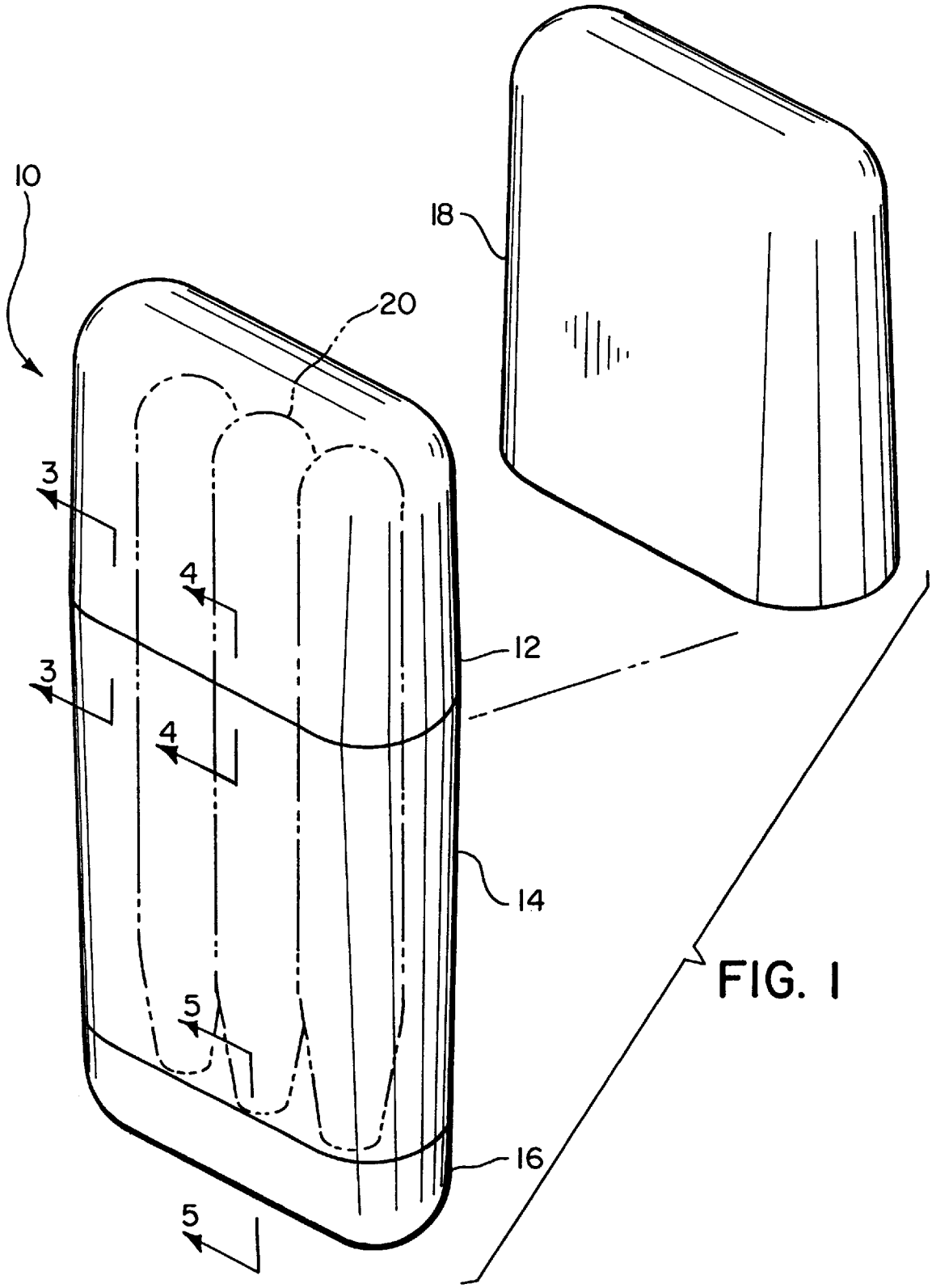
FIG. 1 is a perspective view of a first embodiment of a portable humidor made in accordance with the present invention.

FIG. 1 is perspective view of a preferred embodiment of the present invention. As shown, the humidor 10 is comprised of a removable cover 12, a container 14, and a lower receptacle 16. A longer cover 18 may also be supplied as an alternative to the shorter cover 12 to accommodate longer cigars. Cigars within the container 14 are shown in phantom and are generally indicated by the numeral 20. The removable cover 12, container 14, and the lower receptacle 16 are preferably made of relatively rigid, molded plastic.

Figure 2:
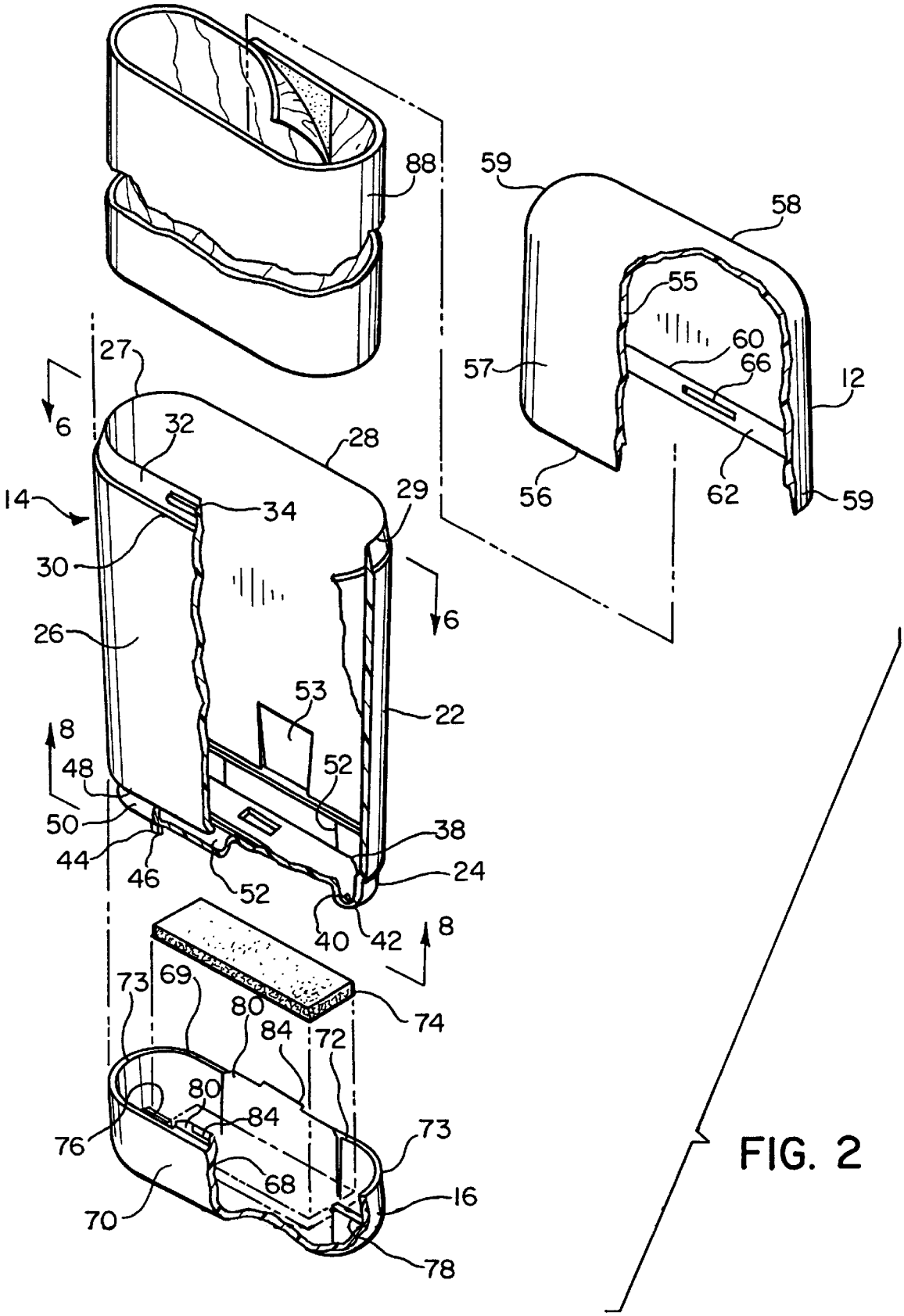
FIG. 2 is an exploded perspective view of the embodiment of FIG. 1, showing the snap-together sections (cover, container, and receptacle) along with the humidifying element that fits into the lower receptacle and the liner which fits into the container.

FIG. 2 provides detailed views of the components of the humidor 10. The container 14 encloses a volume defined by a continuous side wall 22 and a bottom wall 24. In this preferred embodiment, the container 14 has an oval-shaped cross-section. The side wall 22 defines two major, parallel, lateral wall portions 26, 28 separated by approximately one inch, and two arcuate wall portions 27, 29.

The side wall 22 has a generally constant thickness; however, there is a recessed sealing surface 32 near the top of the container 14. This sealing surface 32 terminates in a continuous ridge 30. The sealing surface 32 allows for the mating of the container 14 with the removable cover 12 (or 18). There are two projections 34 which protrude from the sealing surface 32, one corresponding with each major lateral wall portion 26, 28 of the container 14. As will be further discussed herein, these projections 34 mate with corresponding indentations 66 on the removable cover 12 (or 18) allowing the container 14 and the removable cover 12 (or 18) to snap together.

The bottom wall 24 is not a simple planar structure but is comprised of a series of levels. The upper level 38 of the bottom wall 24 is a shelf that supports the cigars within the container. The intermediate level 40 is just below the upper level 38 and surrounds the periphery of the upper level 38. The intermediate level 40 defines a plurality of holes 42, which permit air and moisture from the lower receptacle 16 to enter the container 14. The intermediate level 40 is also the portion of the bottom wall 24 that merges with the side wall 22. Finally, the lower level 44 of the bottom wall 24 is made up of a plurality of legs 46 that serve to maintain a gap between the container 14 and the humidifier 74 (described further herein) in the lower receptacle 16.

Figure 8:
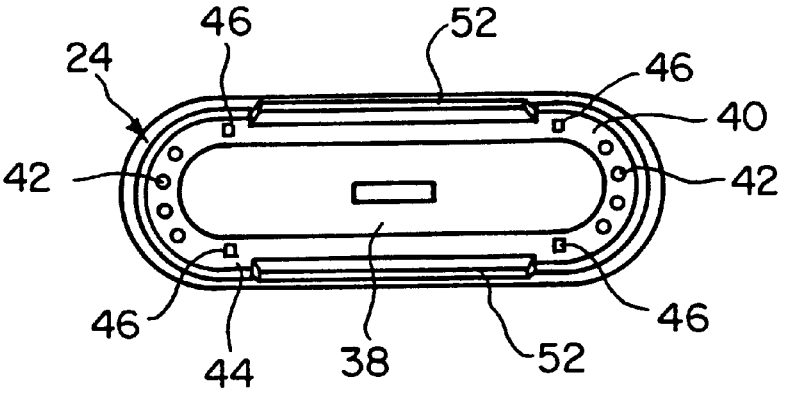
FIG. 8 is a bottom plan view of the container taken along line 8—8 of FIG. 2.

In a preferred embodiment, the upper level 38 of the bottom wall 24 is oval-shaped, as is the intermediate level 40 that surrounds the upper level 38. The lower level 44 is defined by a plurality of legs 46, projecting downwardly from the intermediate level 40. FIG. 8 is a bottom view of the bottom wall 24 and shows the shape of the preferred embodiment as well as the preferred location of the holes 42 of the intermediate level 40 and the legs 46 that define the lower level 44.

Referring again to FIG. 2, where the bottom wall 24 meets the side wall 22, there is a second recessed sealing surface 50 for mating the container 14 with the lower receptacle 16. This sealing surface 50 terminates with a second continuous ridge 48. In this preferred embodiment, there are two holes 52 defined by the second sealing surface 50, one corresponding with each major lateral wall portion 26, 28. The holes 52 allow for mating with projections on the lower receptacle 16 as will be discussed further herein. There are also indentations 53 located just above the mating holes 52 on the internal surface of the container 14.

The removable cover 12 is formed by a continuous wall 55, open at one end 56 and closed at the other. In a preferred embodiment, this removable cover 12 has an oval-shaped cross-section. Similar to the container 14, the cover 12 has two major parallel lateral wall portions 57, 58 connected by two arcuate wall portions 59.

Figure 3:
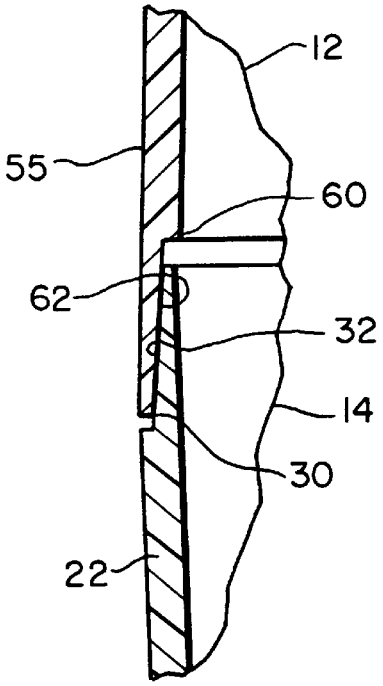
FIG. 3 is a sectional view taken along line 3—3 of FIG. 1.
Figure 4:
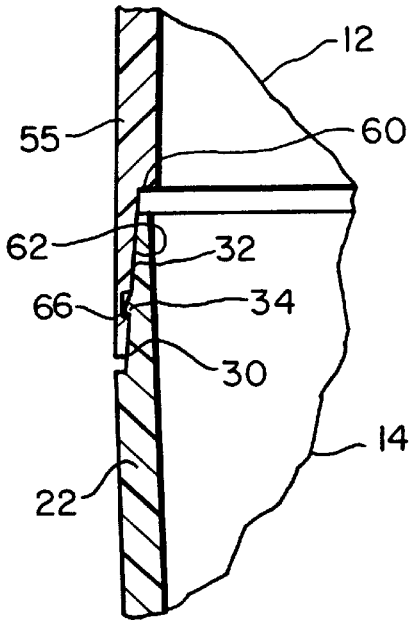
FIG. 4 is a sectional view taken along line 4—4 of FIG. 1.

There is a recessed sealing surface 62 just above the open end 56 of the cover 12 on the internal surface of the continuous wall 55. This sealing surface 62 terminates in a continuous ridge 60. There is a pair of indentations 66 in the sealing surface 62, one corresponding with each major lateral wall portion 57, 58 of the cover 12. These indentations 66 receive the projections 34 of the container, allowing the cover 12 and the container 14 to be snapped together. FIGS. 3 and 4 show two views wherein the removable cover 2 and the container 14 have been snapped together. As shown, the removable cover 12 fits over the sealing surface 32 of the container. The sealing surface 32 of the container 14 and the sealing surface 62 of the cover 12 contact each other along their entire periphery to form a substantially airtight seal between the cover 12 and the container 14 as shown in FIG. 3. FIG. 4 shows how the indentations 66 of the cover 12 receive the projections 34 of the container 14, holding the cover 12 and the container 14 in sealing contact with each other.

Referring again to FIG. 2, the lower receptacle 16 is also defined by a continuous wall 68 that is open at one end 69 and closed at the other. The receptacle 16 has two major parallel lateral wall portions 70, 72 connected by two arcuate wall portions 73. The humidifying element 74 is housed in the lower receptacle 16. This humidifying element 74 is an absorbent material that is saturated by the user with a liquid. In this preferred embodiment, the humidifying element 74 is held in place by a pair of projections 76, 78 extending from the wall 68 of the lower receptacle 16. When the lower receptacle 16 is attached to the container 14, the legs 46 forming the lower level 44 of the bottom wall 24 of the container 14 push down on the top of the humidifying element 74, helping to hold the element 74 in place. In this preferred embodiment, the humidifying element 74 is a rectangular piece of absorbent material. The person using the humidor can saturate the element 74 with any liquid; a preferred liquid is a solution of distilled water and glycol. As for the humidifying element 74 itself, a preferred material is Oasis, which is a material commonly used in the floral industry.

Figure 5:
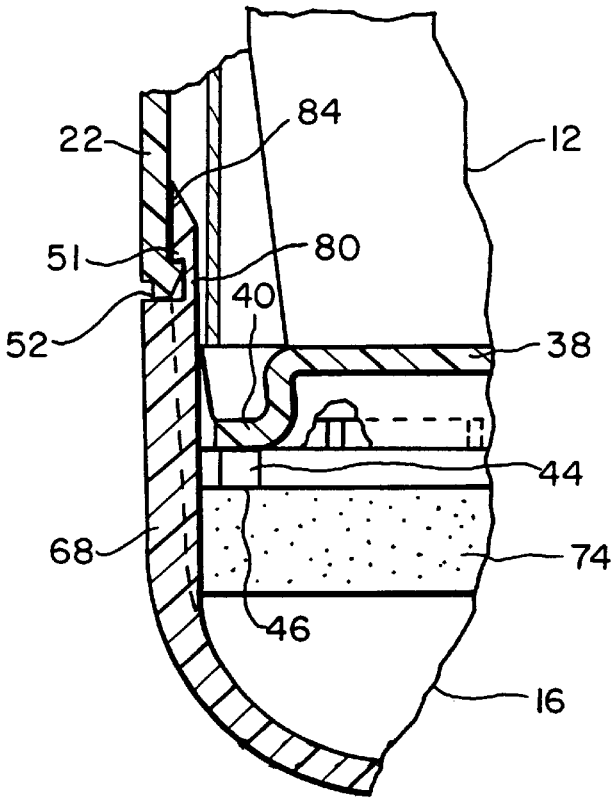
FIG. 5 is a sectional view taken along line 5—5 of FIG. 1.

Two tabs 80 extend upwardly from the open end 69 of the lower receptacle 16, one from each lateral wall portion 70, 72. On each tab 80, there is a perpendicular projection 84. As shown in FIG. 5, the tabs 80 are constructed to align with the holes 52 of the container 14. When the tabs 80 are inserted in the holes 52, the perpendicular projections 84 on the tabs 80 snap into indentations 51 on the internal surface of the container 14, snapping the lower receptacle 16 into place. A substantially airtight seal is made between the mating surfaces of the container 14 and the lower receptacle 16.

Figure 6:
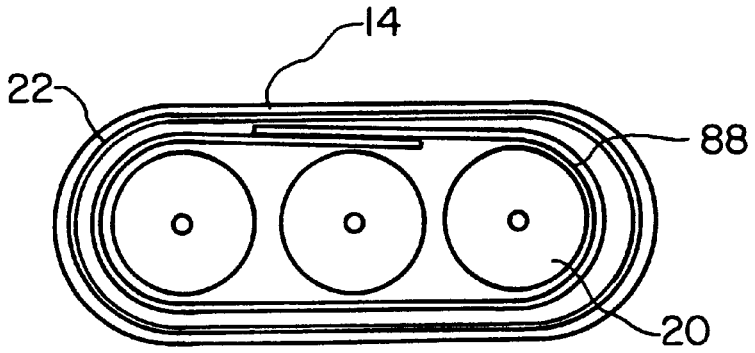
FIG. 6 is a view taken along line 6—6 of FIG. 2, wherein the wood liner is wrapped around three cigars.
Figure 7:
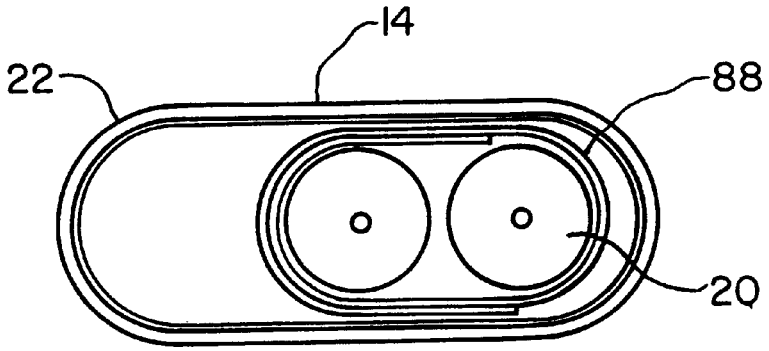
FIG. 7 is a view taken along line 6—6 of FIG. 2, wherein the wood liner is wrapped around two cigars.

As an additional feature, in a preferred embodiment, a flexible wood lining 88 is placed in the container 14, surrounding the cigars. The wood lining 88 is made of cedar that is laminated to paper for flexibility. FIG. 6 shows one embodiment wherein three cigars are wrapped in the wood lining 88. FIG. 7 shows a second embodiment wherein two cigars are wrapped in the wood lining 88. When placed around the cigars, the cedar side faces the cigars, the paper side faces out.

It will be obvious to those skilled in the art that modifications may be made to the embodiment described above without departing from the scope of the present invention.

I claim:

1. A portable humidor comprising:

a container for storing cigars or similar tobacco products, said container including a continuous side wall, a closed bottom and an open top;

a cover attached to said container top; and, a receptacle attached to said container bottom; wherein, said container bottom includes an upper level for supporting said cigars thereon and a lower level depending into said receptacle, said upper level having at least one hole therethrough and said lower level also having at least one hole therethrough.

2. The portable humidor of claim 1, further comprising:

a humidifying element disposed within in said receptacle to provide moisture to said container through said at least one hole in said lower level of said container bottom, said upper and lower levels of said container bottom cooperating to position said cigars in spaced relation to said humidifying element.

3. The portable humidor of claim 1, further comprising:

a thin wooden liner disposed within said container.

4. The portable humidor of claim 3, wherein said wooden liner is made of a wood layer laminated to a paper layer.

5. The portable humidor of claim 1, wherein:

said cover defines an inner perimetrical sealing surface having at least one cover projection, said container open top defines an outer perimetrical sealing surface having at least one container top indentation, and a substantially airtight seal is created between said cover inner sealing surface and said container open top outer sealing surface when said at least one cover projection is received by said at least one cover top indentation; and wherein, said receptacle defines an inner perimetrical sealing surface having at least one receptacle projection, said container bottom defines an outer perimetrical sealing surface having at least one container bottom indentation, and a substantially airtight seal is created between said receptacle inner sealing surface and said container bottom outer sealing surface when said at least one receptacle projection is received by said at least one container bottom indentation.

* * * * *

UNITED STATES PATENT AND TRADEMARK OFFICE

CERTIFICATE OF CORRECTION

PATENT NO. : 6,112,889
DATED : September 5, 2000
INVENTOR(S) : Kenneth R. Wicker It is certified that error appears in the above-identified patent and that said Letters Patent is hereby corrected as shown below:

Column 3,
Line 38, change "2" to --12--.

Signed and Sealed this

Seventeenth Day of July, 2001

*Attest:*

Nicholas P. Godici

NICHOLAS P. GODICI
*Acting Director of the United States Patent and Trademark Office*

*Attesting Officer*